US009428360B2

(12) United States Patent
Herrmann et al.

(10) Patent No.: US 9,428,360 B2
(45) Date of Patent: Aug. 30, 2016

(54) SYSTEMS AND METHODS FOR IMPLEMENTING REMOVAL OF DETECTED WRINKLING FOR WEB PRINTING IN A POST PROCESSING DEVICE OF AN IMAGE FORMING SYSTEM

(71) Applicant: XEROX Corporation, Norwalk, CT (US)

(72) Inventors: Douglas K. Herrmann, Webster, NY (US); Jason M. LeFevre, Penfield, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 262 days.

(21) Appl. No.: 14/185,949

(22) Filed: Feb. 21, 2014

(65) Prior Publication Data

US 2015/0239698 A1 Aug. 27, 2015

(51) Int. Cl.
*B65H 23/032* (2006.01)
*B65H 23/038* (2006.01)

(52) U.S. Cl.
CPC ..... *B65H 23/032* (2013.01); *B65H 23/038* (2013.01); *B65H 2301/33214* (2013.01); *B65H 2301/44318* (2013.01); *B65H 2404/144* (2013.01); *B65H 2511/512* (2013.01); *B65H 2515/842* (2013.01); *B65H 2553/41* (2013.01); *B65H 2557/264* (2013.01); *B65H 2801/03* (2013.01); *B65H 2801/12* (2013.01)

(58) Field of Classification Search
CPC ..... B65H 23/032; B65H 23/0322; B65H 23/0324; B65H 23/46; B65H 2301/33214; B65H 2301/44318; B65H 2404/144; B65H 2404/1441; B65H 2511/512; B65H 2511/516; B65H 23/462
See application file for complete search history.

(56) References Cited

U.S. PATENT DOCUMENTS 6,098,863 A * 8/2000 Hevenor ..... B41J 11/0055 226/15
2012/0118186 A1* 5/2012 Nishiyama ..... B41F 13/025 101/248

* cited by examiner

*Primary Examiner* — Michael McCullough
(74) *Attorney, Agent, or Firm* — Ronald E. Prass, Jr.; Prass LLP

(57) ABSTRACT

A system and method are provided for implementing an automated process that independently manipulates a plurality of span-wise discrete individual pressure actuators in a movable pressure assembly associated with a nip-based drive unit to drive tensioned web continuous feed image receiving media in web-based printing devices. The disclosed process varyingly adjusts a relative pressure of between the opposing rolls to address a detected wrinkling condition. A closed loop detection and control scheme is provided in which, based on a determination that wrinkling is occurring in tensioned web continuous feed image receiving media, and isolation of a spanwise location in which the wrinkling is occurring, differential signals may be sent to one or more of a plurality of span-wise discrete individual pressure actuators in a movable pressure assembly to varyingly adjust a relative pressure of the two opposing rolls across a spanwise pressure nip.

23 Claims, 8 Drawing Sheets

SYSTEMS AND METHODS FOR IMPLEMENTING REMOVAL OF DETECTED WRINKLING FOR WEB PRINTING IN A POST PROCESSING DEVICE OF AN IMAGE FORMING SYSTEM

This disclosure is related to U.S. patent application Ser. No. 13/852,096, entitled "WRINKLE DETECTION IN CONTINUOUS FEED PRINTERS" to HERRMANN et al., filed on Mar. 28, 2013, the disclosure of which is hereby incorporated by reference herein in its entirety.

BACKGROUND

1. Field of Disclosed Subject Matter

This disclosure relates to systems and methods for implementing a closed loop processing and control scheme for providing automated control of mechanical components to effect removal of detected wrinkle conditions, while limiting differential nip pressure forces, in tensioned web continuous feed image receiving media in web-based printing devices, including post processing devices, for advanced image forming systems.

2. Related Art

Many modern, sometimes complex, image forming systems make use of continuous feed or web material image receiving media, which is fed from rolls or stacks as the image receiving media sources. FIG. 1 illustrates a block diagram of a general configuration of an image forming system 100 that employs continuous feed or web material image receiving media. A roll of web material image receiving media 110 is provided as an image receiving media source. Images are printed on the continuous feed or web material image receiving media in particular page layouts, for example, according to instructions from an image production source (not shown) by a media marking device 120.

Media marking devices, as those devices may be referenced throughout this disclosure, are not intended to be devices that are restricted to employment of any particular media marking materials, e.g., inks, toners and the like, or to any particular delivery mechanisms for those media marking materials, including but not limited to, xerographic image forming, inkjet delivery, laser marking, lithographic ink delivery or the like. Further, the media marking devices described in this disclosure may include initial image finishing components, e.g., fuser modules for fusing and/or fixing the delivered media marking materials on the surfaces of the image receiving media substrates by heat, pressure, or a combination of the two. It should be recognized, however, that the initial image finishing components may be separate, stand-alone devices or may be incorporated as portions of other media post-processing devices 130.

Downstream, in a process direction, of the media marking device 120 may be one or more media post-processing devices 130 for executing post-processing on the now-imaged continuous feed or web material image receiving media prior to forwarding a finished printed document to a media output receptacle 140 for recovery by a user. The post-processing carried out on the media by the post-processing devices 130 can involve one or more of myriad methodologies that are implemented for document finishing. The media post-processing devices 130 may employ technologies for fixing images on the surfaces of the continuous feed or web material image receiving media, or may separately provide, for example, cutting, collating, stacking, sorting, binding and/or stapling of imaged image receiving media substrates to form finished documents. The media post-processing devices 130 may, for example, cut individual pages from the continuous feed or web material image receiving media, and stack and collate those pages, and drill and bind those pages, as a finished output document.

Handling of continuous feed or web material image receiving media in complex image forming systems, such as those systems described generally above, requires particular attention once marking material has been deposited on the image receiving media and while the marked images undergo post-processing. Image durability issues may be addressed in post-processing and finishing devices in a number of ways including heat/pressure fusing and/or over coatings including waxes, oils, acrylics or other clear coatings, and many other techniques, objectives of which are to attempt to ensure that the marking material, e.g., ink or toner, does not offset in or onto downstream post-processing devices.

Continuous feed or web material image receiving media can generally be transported through a complex image forming system, and individual devices of that image forming system, by one of two transport mechanisms depending on particular characteristics of the operations undertaken by the individual devices, and particularly post-processing devices. In individual devices that may comprise the increasingly complex image forming systems, consideration must be taken on how to control the transport of the continuous feed or web material image receiving media as it passes through each of the particular devices that may be arranged in differing orders and in differing configurations to make up the image forming systems. The two generally-understood typical scenarios that exist with regard to driving the continuous feed or web material image receiving media are that: (1) the continuous feed or web material image receiving media may be pulled through the system by a downstream device, creating generally a tight or tensioned (or wrap) web through the system, or at least in individual devices in the system; and/or (2) the continuous feed or web material image receiving media may be generally slackened as it enters the downstream device, in which case, the continuous feed or web material image receiving media is driven by a pressure nip acting on the continuous feed or web material image receiving media in the downstream device. Regardless of the mechanism, in order to preserve image quality and not damage the continuous feed or web material image receiving media, there is a need to control all aspects, e.g. speed, of transport of the material through each of the devices and through the system overall so that the continuous feed or web material image receiving media does not bind between devices, and otherwise does not break as it is passed through the system and passed through the individual devices that comprise that system.

SUMMARY OF THE DISCLOSED EMBODIMENTS

U.S. patent application Ser. No. 13/852,096 (the 096 application), entitled "WRINKLE DETECTION IN CONTINUOUS FEED PRINTERS" to HERRMANN et al., filed on Mar. 28, 2013, the disclosure of which is incorporated by reference herein in its entirety, discusses difficulties that can arise when forming and fixing images on tensioned web continuous feed image receiving media in web printing devices. Particularly, the 096 application depicts, in FIG. 8, a particular configuration of a conventional inkjet printer that ejects ink onto a continuous web of media as the media moves past the inkjet printheads in the depicted system. The 096 application describes issues arising when wrinkles form in the media web, principally occurring when a high-load pressure roll is in an out-of-alignment condition with respect to an image side fixing roll. The 096 application discloses that detection of such a condition, which adversely affects image quality in the disclosed existing systems, is conventionally limited to a system operator or observer periodically inspecting a condition of the web of media downstream of the high-load pressure roll to visually detect a presence of wrinkles. Once detected, the system operator or observer may implement a manual maintenance procedure to attempt to eliminate the wrinkle condition.

With reference to FIG. 6, the 096 application depicts and discusses details of one configuration of a high-load pressure roll cooperating with an image side fixing roll to form a fixing and drive nip that may induce the disadvantageous wrinkling in the web of media. Specifically, the 096 application depicts a high-load pressure roll being attached to a movable pressure assembly that is usable to adjust a relative position of the high-load pressure roll with respect to the image side fixing roll "to increase or decrease the pressure in the nip." The disclosed movable pressure assembly includes inboard and outboard actuators (specifically airbags) that are independently adjustable (inflatable and deflatable) against a surface to adjust a force of the high-load pressure roll across a cross-process direction with respect to the image side fixing roll. The 096 application indicates that the system operator or observer may "actuate[ ] manual pumps to inflate or deflate the airbags" or may cause a controller to "operate[ ] one or more electronic pumps to inflate or deflate the airbags." This open loop manual procedure may result in greater than required forces being applied to increase the pressure in the nip thereby causing excess wear on at least one of the high-load pressure roll and the image side fixing roll.

The 096 application explains that once a wrinkle condition is generally detected, the system operator or observer must further attempt to ascertain whether the wrinkle is inboard or outboard of the center of the web of media so that the high-load pressure roll can be properly adjusted. Particularly, if the web is wrinkling on either the inboard edge or the outboard edge, that individual edge of the nip needs to be rotated faster. Those of skill in the art recognize that in order to make one edge move faster relative to the center of the nip, the system operator or observer must manipulate the pressure actuators in a manner that applies more load to the edge that is wrinkling. This may be accomplished by increasing a pressure on the edge that is wrinkling or by decreasing a pressure on the edge that is not wrinkling, within limits, or within an operating range.

The system disclosed in the 096 application addresses difficulties in manual observation and visual detection by introducing a scheme for automated detection of a presence of a wrinkle condition in the web of media downstream of the nip noting that "automated detection of the presence and position of a wrinkle in moving web is desirable." The system disclosed in the 096 application does not, however, remove a requirement for manual intervention by the system operator or observer in adjusting the pressures once a wrinkle condition is detected according to the disclosed method. The system disclosed in the 096 application also does not provide any feedback to the system operator or observer regarding potential for reduction in the differential pressure that may successfully effect wrinkle reduction without causing undue wear on system components due to overpressure.

It would be advantageous in view of the above-noted circumstances arising from image forming and fixing operations in complex image forming systems employing continuous feed or web material image receiving media substrates to implement an automated process for independently manipulating a plurality of span-wise discrete individual pressure actuators in a movable pressure assembly to varyingly adjust a relative pressure of a high-load pressure roll with respect to an image side fixing roll to address a detected wrinkling condition. It would be further advantageous to implement a feedback system in which elimination of a wrinkle condition is monitored as differential pressures are reduced to implement a lowest pressure level at which effective wrinkle removal can be maintained.

Exemplary embodiments of the systems and methods according to this disclosure may implement a processing scheme for automated actuation of pressure devices to remove detected wrinkling in tensioned web continuous feed image receiving media in web printing devices, including post processing devices, for advanced image forming systems.

Exemplary embodiments may provide a closed loop detection and control scheme whereby, based on a determination that wrinkling is occurring in tensioned web continuous feed image receiving media, and isolation of a spanwise location in which the wrinkling is occurring, differential signals may be sent to one or more of a plurality of span-wise discrete individual pressure actuators in a movable pressure assembly to varyingly adjust a relative pressure of a high-load pressure roll with respect to an image side fixing roll to address the detected and/or isolated wrinkling condition.

In embodiments, individual pressure actuators may include one or more of piston, lever or other mechanical actuators, and/or individually manipulable (pressurizable) air inflatable devices, such as airbags, and/or other like devices.

Exemplary embodiments may confirm through analysis of a post-correction imaged web media substrate that the corrections made to spanwise pressures in the movable pressure device have corrected the detected wrinkle condition for the web media substrate.

Exemplary embodiments may facilitate complete closed loop control of wrinkle removal in a continuous web. By continuously checking for wrinkle and then adjusting the system pressure to remove the wrinkle, the system may function completely autonomously of user input in both wrinkle detection and the response to that detection. By automating different pressures applied to one of more of the opposing rolls by individual actuators, the disclosed systems and methods may continuously and iteratively make small (<10 kgf) adjustments on the fly to the pressures applied to the opposing rolls to remove wrinkles as they are detected without the need to stop the image forming system and make manual adjustments.

In embodiments, optimization of pressure roll adjustments may be further automated to, for example, remove a variability currently attributed to individual system operator or observer adjustments.

In embodiments, pressure adjustments may be made immediately upon detecting variability in width detected by the wrinkle detection sensors and markings.

Exemplary embodiments may provide feedback to a user as to (1) detection of a wrinkle condition in the web media, (2) status of automated adjustments made to address the wrinkle condition, and/or (3) confirmation that the wrinkle condition has been mitigated and/or eliminated.

Exemplary embodiments may continuously balance in small increments (<10 kgf) biasing between the pressure actuating devices to minimize total pressure by optimizing the delta pressures needed to eliminate the detected wrinkle condition, thereby reducing wear on the opposing rolls.

In embodiments, the disclosed schemes may allow for a controlled pressure calculation rather than relying on the system operator or observer iterating by increasing only one side of the roll in large increments (10 kgf/increment), which leads to higher wear, inaccurate settings, and more frequent roll replacement.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for implementing a processing and/or control scheme for automated actuation of devices to remove a detected wrinkling condition, while limiting differential nip pressure forces, in tensioned web continuous feed image receiving media in a web printing device, including a post processing device for an advanced image forming system, will be described, in detail, with reference to the following drawings, in which.

DETAILED DESCRIPTION OF THE DISCLOSED EMBODIMENTS

The systems and methods for implementing a processing and/or control scheme for automated actuation of devices to remove detected wrinkling, while limiting differential nip pressure forces, in tensioned web continuous feed image receiving media in a web printing device, including a post processing device, for an advanced image forming system according to this disclosure will generally refer to this specific utility or function for those systems and methods. Exemplary embodiments described and depicted in this disclosure should not be interpreted as being specifically limited to any particular configuration of the described elements, or as being specifically directed to any particular intended use, including any particular functioning or operation of a processing, post-processing or other component device in an image forming system in which an automatically adjustable differential pressure system may be advantageously employed to modify web characteristics including a disadvantageous introduction of wrinkling in a web media substrate. Any advantageous combination of features, schemes, techniques and/or processes that may employ a particular structure for providing an adjustable differential spanwise pressure in response to detected wrinkle conditions in a web media in a tensioned (pulled) web driving configuration, and a closed-loop control system to optimize spanwise differential pressures, is contemplated as being encompassed by this disclosure.

Specific reference to, for example, various configurations of image forming systems and component devices within those systems, including post-processors, as those concepts and related terms are captured and used throughout this disclosure, should not be considered as limiting those concepts or terms to any particular configuration of the respective devices, the system configurations or the individual elements. The subject matter of this disclosure is intended to broadly encompass systems, devices, schemes and elements that may involve image forming and finishing operations as those operations would be familiar to those of skill in the art. The disclosed concepts are particularly adapted to implementing, in an automated scheme, adjustable pressures for a fusing and drive nip that pulls a continuous feed or web material image receiving media through a complex image forming system.

Figure 1:
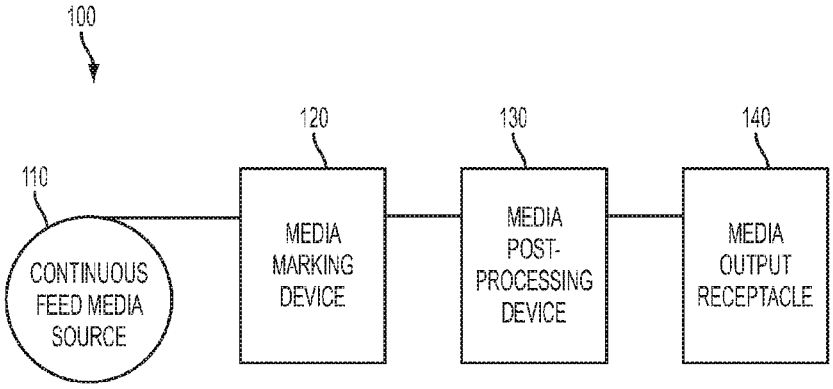
FIG. 1 PRIOR ART
FIG. 1 illustrates a block diagram of a general configuration of an image forming system that employs continuous feed or web material as an image receiving media substrate.
Figure 2:
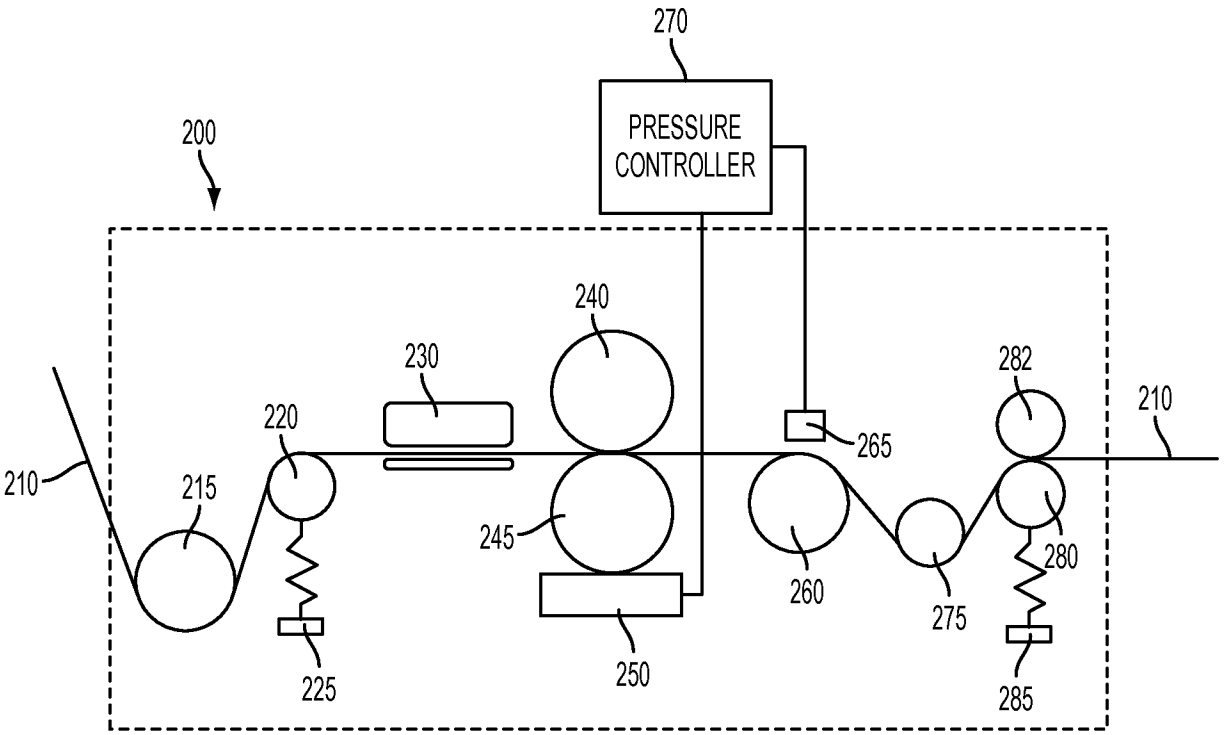
FIG. 2 illustrates a schematic diagram of an exemplary controllable wrinkle detection and removal system associated with a high-load pressure roll and opposing image side fusing roll that face each other to form a fusing and drive nip to support tensioned web nip driving for the continuous feed or web material image receiving media in an image forming system according to this disclosure.

FIG. 2 illustrates a schematic diagram of an exemplary controllable wrinkle detection and removal system 200 associated with a high-load pressure roll 245 and an opposing image side fusing roll 240 that face each other to form a fusing and drive nip to support tensioned web nip driving for the continuous feed or web material image receiving media ("web media") 210 in an image forming system. As shown in FIG. 2, web media 210 exiting an upstream marking device (see FIG. 1) may be directed through the exemplary system 200. The exemplary system 200 may include one or more of: a leveler roll 215; one or more tension rolls 220,280 (with associated tensioners 225,285), which may or may not include an opposing roll 282; an in-process or in-line heater 230; and/or a combination of rolls 260,275 forming some manner of S-wrap for the web media 210. The exemplary system 200 may be centered around the nip driving device configured of the high-load pressure roll 245 and the opposing image side fusing roll 240 that face each other to form the fusing and drive nip. A movable and/or adjustable pressure device 250 may be provided to variably adjust a pressure at the fusing and drive nip across a spanwise length of the fusing and drive nip between the high-load pressure roll 245 and the opposing image side fusing roll 240. Although depicted in FIG. 2 as being associated with high-load pressure roll 245, the movable and/or adjustable pressure device 250 may be alternatively associated with the image side fusing roll 240. The movable and/or adjustable pressure device 250 may be comprised of a plurality of spanwise pressure-applying actuators for independently adjusting spanwise pressures in the fusing and drive nip formed by the high-load pressure roll 245 and the opposing image side fusing roll 240.

A spanwise sensor array 265 may be provided to read or image a surface of the web media 210 as it passes over one or more of the rolls downstream of the fusing and drive nip. Details of the image sensing undertaken by the spanwise sensor array 265 will be described below with reference to FIGS. 3-5. Information collected regarding the read or imaged surface of the web media 210 by the spanwise sensor array 265 may be provided to a processor or pressure controller 270. When the collected information detects and/or isolates a wrinkle condition in the web media 210 downstream of the fusing and drive nip, control signals may be sent from the pressure controller 270 to independently adjust pressures in the plurality of spanwise pressure actuators that combine to comprise the movable and/or adjustable pressure device 250, the independently adjusted pressures in the pressure actuators serving to modify the spanwise pressure across the fusing and drive nip in a manner that is directed at addressing the wrinkle condition. After pressure adjustment, information may again be collected via the spanwise sensor array 265 regarding the read or imaged surface of the web media 210 by the spanwise sensor array 265 that may confirm mitigation and/or substantial elimination of the wrinkled condition. An iterative process of detection and pressure adjustment may be undertaken that progressively independently adjusts the pressures in the pressure actuators to a lowest level.

The disclosed iterative process may implement an algorithm to control the pressures. The algorithm may continuously balance, in small increments (<10 kgf), the differential pressures in the pressure actuators to minimize total pressure by optimizing the delta pressures needed to eliminate the detected wrinkle condition. Such closed-loop control of the process may advantageously reduce wear on the rolls. The disclosed scheme may provide a controlled pressure calculation rather than relying on the system operator or observer manually iterating by increasing only one side of the roll in large increments (10 kgf/increment), which leads to higher wear, inaccurate settings, and more frequent roll replacement.

The disclosed scheme addresses a shortfall in conventional operations in which the system operator or observer typically continues to increase pressure in one of the pressure actuators to maximum and only then works to reduce the pressure in others of the pressure actuators to modify the spanwise differential pressures, thereby changing the bias. The disclosed schemes may additionally automatically account for other variable environmental or operating parameters, including ambient temp and relative humidity, media weight and media width.

The disclosed scheme may further implement a learning function that results in improvement to the iterative process based on the inputs including media characteristics, environmental characteristics and roll wear characteristics. This scheme may, for example, incorporate information about the media width and use this information to more quickly arrive at the optimal (non-wrinkling) load settings. This can prove advantageous because the media marking device may be edge-registered. As a result, media that is narrower than a specified full maximum process width may require a smaller force on the non-registered edge than on the registered edge in order to deliver a symmetric (desired) nip profile. Consequently, a desired state of operation of this control scheme may encompass making incremental changes in loading as a constant percentage of a target-loading set-point for a given one of the pressure actuators for a given media width. This may be a preferable pressure adjustment technique because, if a constant load increment was applied (say 10 kgf), this would have a greater impact on a non-registered edge mechanism than on a registered edge mechanism. Applying incremental change as a constant percentage of the nominal loading set-point may prevent a circumstance in which the optimal pressure differential is overshot because an increment of adjustment is too large.

Figure 3:
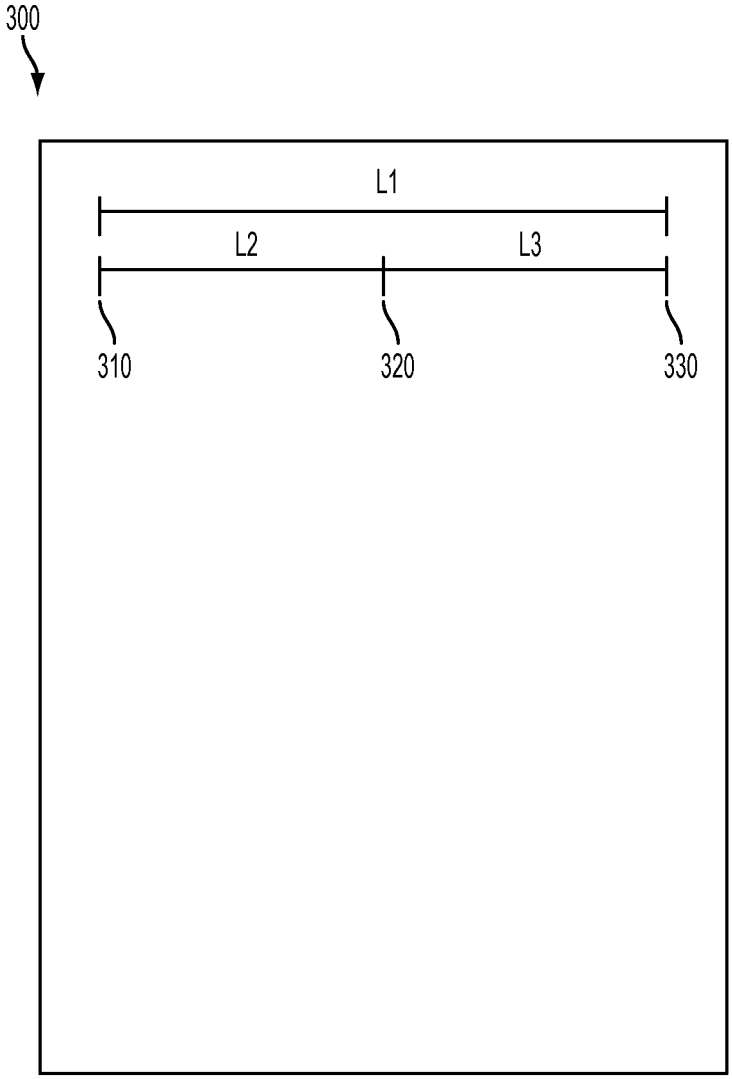
FIG. 3 illustrates an example of a media marking scheme to facilitate wrinkle detection in support of the wrinkle removal techniques according to this disclosure.

FIG. 3 illustrates an example of a media marking scheme to facilitate wrinkle detection in support of the disclosed wrinkle removal techniques in an image forming system. As shown in FIG. 3, web media 300 may be marked with a plurality of marks 310,320,330, generally in an inter-document zone on the web media 300. The plurality of marks 310,320,330 may be formed on the surface of the web media 300 with a nominal or known spacing L1 between an inboard mark 310 and an outboard mark 330, a nominal or known spacing L2 between an inboard mark 310 and a center mark 320 and/or a nominal or known spacing L3 between a center mark 320 and an outboard mark 330. The plurality of marks 310,320,330 may be pre-printed at intervals on the web media 300 in a process direction, or may be formed on the web media 300 at intervals in a process direction by a marking engine in the image forming system. In embodiments, the plurality of marks 310,320,330 may be placed in inter-document zones on the web media 300.

Figure 4:
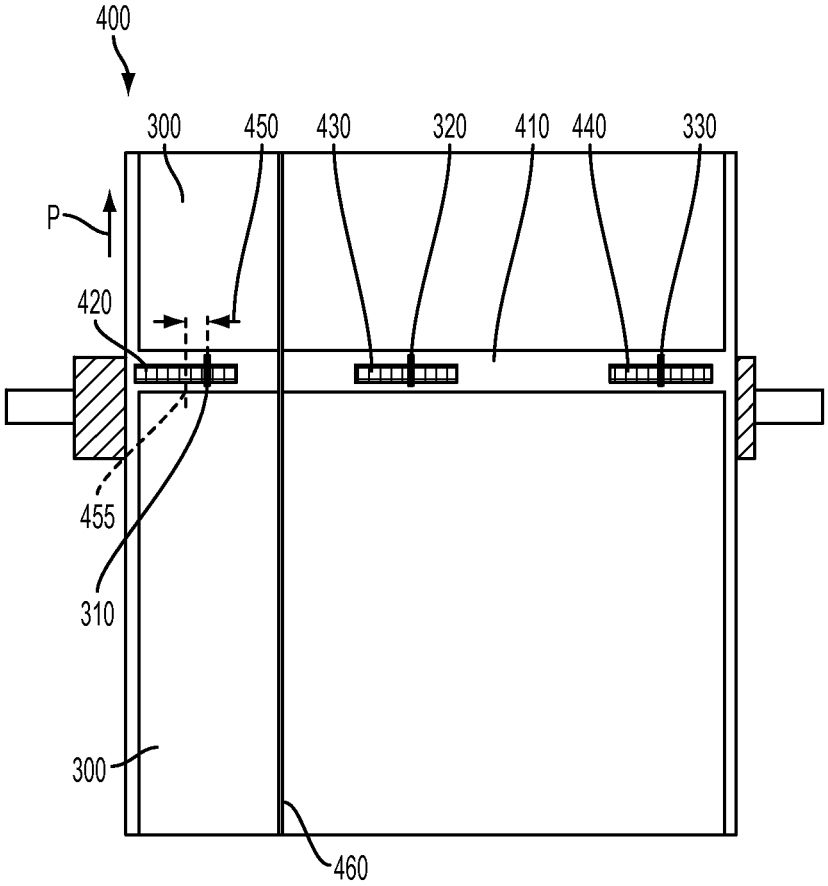
FIG. 4 illustrates a plan view of an exemplary sensor for wrinkle detection in support of the wrinkle removal techniques according to this disclosure.
Figure 5:
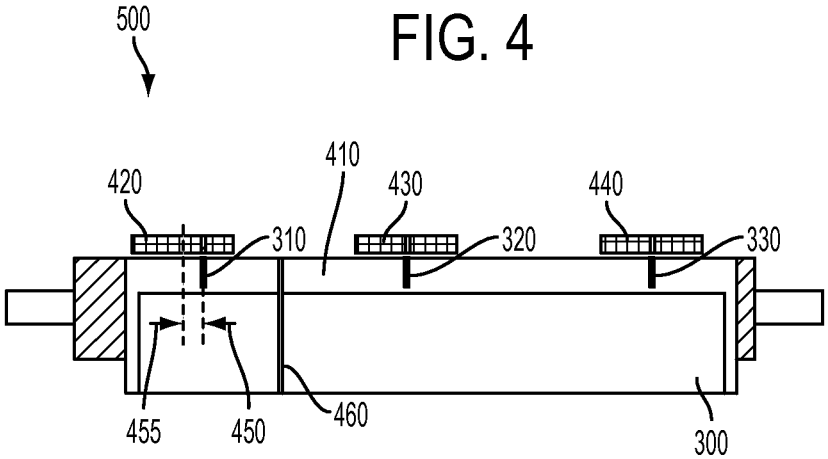
FIG. 5 illustrates an end view of the exemplary sensor shown in FIG. 4 for wrinkle detection in support of the wrinkle removal techniques according to this disclosure.

FIG. 4 illustrates a plan view of an exemplary sensor 400 for wrinkle detection in support of the disclosed wrinkle removal techniques. FIG. 5 illustrates an end view of the exemplary sensor shown in FIG. 4 for wrinkle detection in support of the disclosed wrinkle removal techniques. As shown in FIGS. 4 and 5, a spanwise sensor array 410 that may be comprised of a plurality of discrete sensor array components 420,430,440 that may be arranged to particularly discern a position of a plurality of marks 310,320,330 in an inter-document zone of the web media 300, the plurality of marks 310,320,330 representing spanwise marked reference positions on the web media 300. In embodiments, the plurality of marks 310,320,330 may be marked at each consecutive inter-document zone along the web media 300 as it is translated in a process direction P. In embodiments, the plurality of marks 310,320,330 may be marked at every other inter-document zone in the process direction P. In embodiments, the plurality of marks 310,320,330 may be intermittently marked as part of a manual or automatic maintenance procedure.

In embodiments, the sensor array components 420,430,440 may include a plurality of contact image sensors positioned to detect the marked reference positions. In the embodiment shown, an inboard sensor array component 420 may be positioned to detect the marked inboard position 310, a center sensor array component 430 may be positioned to detect the marked center position 320, and an outboard sensor array component 440 may be positioned to detect the marked outboard position 330. The sensor array components 420,430,440 may be positioned such that each reference position moves past an approximate midpoint of the associated sensor array component when the spacings between the reference positions are the nominal or known spacings L1,L2,L3. The nominal or known spacings between the sensor array components 420,430,440 may be calibrated as part of a setup procedure. The use of a discrete plurality of marks 310,320,330 allows for the use of shorter-length contact image sensors—meaning the sensor array components 420,430,440 may be shorter in the cross-process direction—because it is not necessary to scan the entire web media width.

The formation of a wrinkle 460 in the web media 300 may cause the locations of the marked reference positions represented by the plurality of marks 310,320,330 to change with respect to each other and with respect to the sensor array components 420,430,440. In the embodiment shown in FIGS. 4 and 5, the wrinkle 460 may be formed between the center position 320 and the inboard position 310. The distance between these positions is reduced and represents an inboard wrinkle distance that is less than the inboard nominal or known distance L2. The distance between center position 320 and the outboard position 330 remains the outboard nominal or known distance L3 because the wrinkle 460 does not affect the width of the web media 300 between these positions. The distance between the inboard position 310 and the outboard position 330 is reduced due to the wrinkle and represents a deviation in the overall nominal or known distance L1. The calibrated positioning of the sensor array components 420,430,440 enables each of the sensors to detect if its corresponding mark 310,320,330 is shifted from, for example, a target position 455 to an offset position 450. Image data generated by the sensor array component 420 may enable a controller or processor to calculate a distance off target for that shifted position and to implement corrective action based on that calculation.

Figure 6:
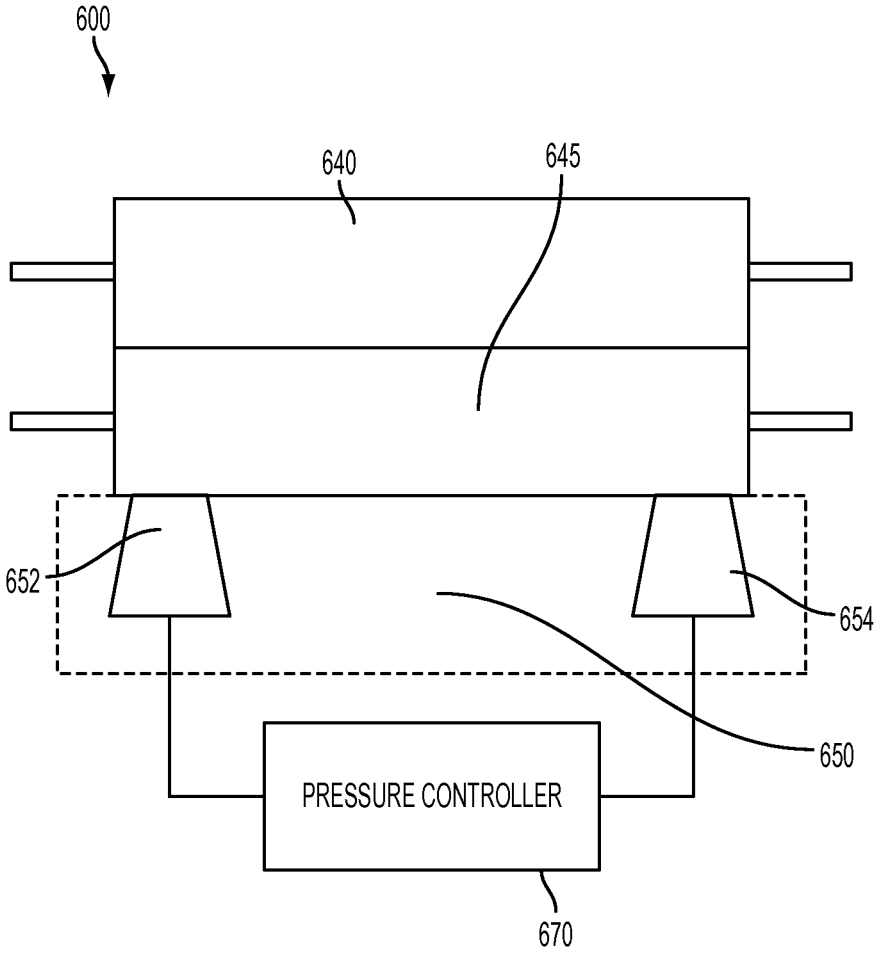
FIG. 6 illustrates an exemplary configuration of a high-load pressure roll and opposing image side fusing roll that face each other to form a fusing and drive nip to support tensioned web nip driving for the continuous feed or web material image receiving media in an image forming system including a feedback controlled automated pressure adjusting mechanism according to this disclosure.

FIG. 6 illustrates an exemplary configuration 600 of a high-load pressure roll 645 and opposing image side fusing roll 640 that face each other to form a fusing and drive nip to support tensioned web nip driving for the continuous feed or web material image receiving media in an image forming system including a feedback controlled automated pressure adjusting mechanism 650 according to this disclosure. The feedback controlled automated pressure adjusting mechanism 650 may be provided to variably adjust a pressure at the fusing and drive nip across a spanwise length of the fusing and drive nip between the high-load pressure roll 645 and the opposing image side fusing roll 640. The feedback controlled automated pressure adjusting mechanism 650 may be comprised of a plurality of spanwise actuators 652,654 for independently adjusting spanwise pressures in the fusing and drive nip formed by the high-load pressure roll 645 and the opposing image side fusing roll 640 according to signals received from a processor or pressure controller 670, the signals being generated in the pressure controller 670 based on detection and isolation of a wrinkle condition in the driven continuous feed or web material image receiving media. Individual ones of the plurality of spanwise actuators 652,654 for independently adjusting spanwise pressures in the fusing and drive nip may include one or more of piston, lever or other mechanical actuators, and/or individually manipulable (pressurizable) air inflatable devices, such as airbags, and/or other like devices that may be powered based on signals from the pressure controller 670.

Figure 7:
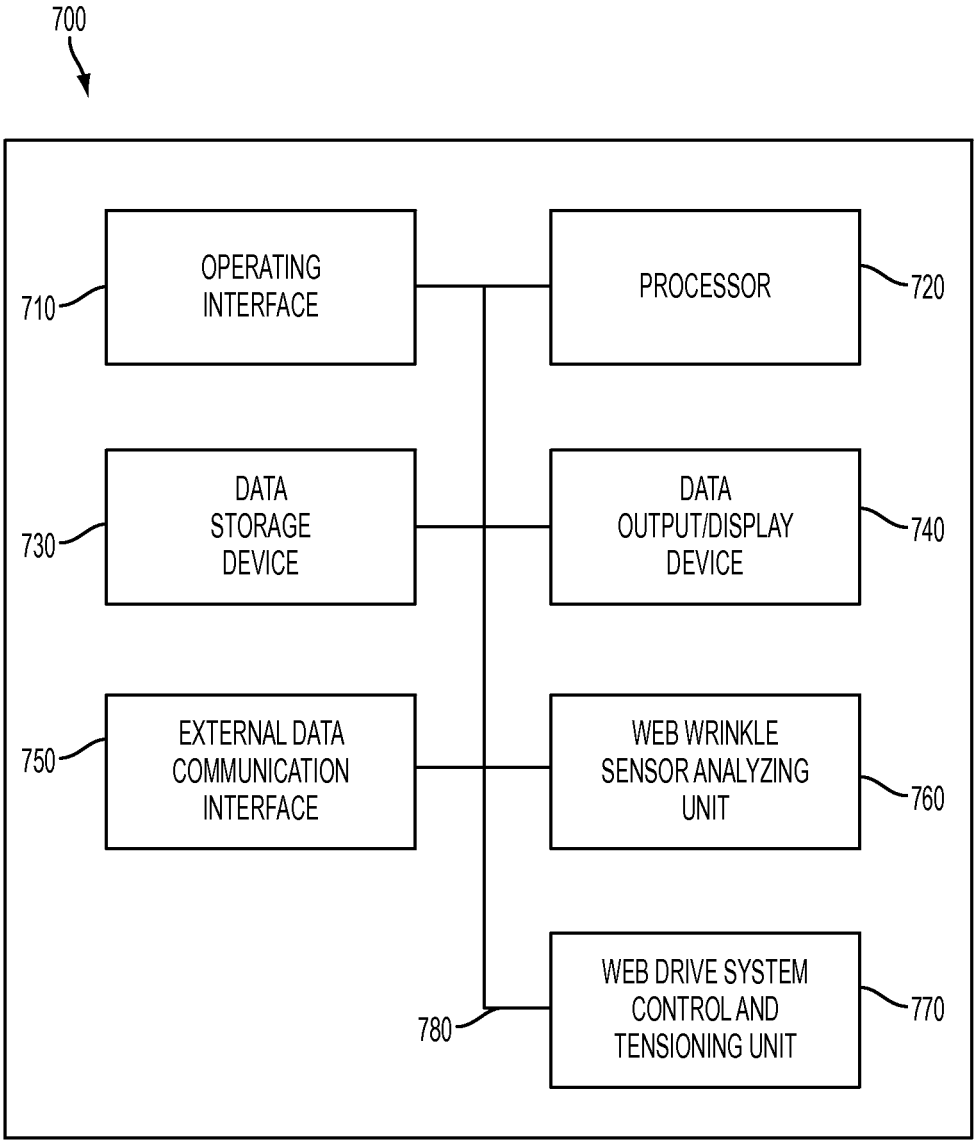
FIG. 7 illustrates a block diagram of a control system for controlling a wrinkle detection and control device according to this disclosure.

FIG. 7 illustrates a block diagram of an exemplary control system 700 for controlling a wrinkle detection and control device according to this disclosure. The exemplary control system 700 shown in FIG. 7 may be implemented as a unit integral to a complex image forming system, or it may be implemented as a separate unit remote from, and in communication with, the complex image forming system.

The exemplary control system 700 may include an operating interface 710 by which a user may communicate with the exemplary control system 700 for directing at least a mode of operation of an adjustable wrinkle detection and control device in the image forming system. Control inputs received in the exemplary control system 700 via the operating interface 710 may be processed and communicated to the image forming system via a web drive system control and tensioning unit 770.

The operating interface 710 may be a locally accessible user interface associated with the image forming system, which may be configured as one or more conventional mechanisms common to control devices and/or computing devices that may permit a user to input information to the exemplary control system 700. The operating interface 710 may include, for example, a conventional keyboard, a touchscreen with "soft" buttons or with various components for use with a compatible stylus, a microphone by which a user may provide oral commands to the exemplary control system 700 to be "translated" by a voice recognition program, or other like device by which a user may communicate specific operating instructions to the exemplary control system 700. The operating interface 710 may be a part of a function of a graphical user interface (GUI) mounted on, integral to, or associated with, the image forming system with which the exemplary control system 700 is associated to direct processing or post-processing image receiving media transport in the associated image forming system.

The exemplary control system 700 may include one or more local processors 720 for individually operating the exemplary control system 700 and for carrying out operating functions associated with the wrinkle detection and correction in the associated image forming system. The processor 720 may reference system characteristics that may include, for example, a constitution of the continuous feed or web material that comprises the image receiving media to predict a potential for wrinkles to be formed in the continuous feed or web material image receiving media. The processor 720 may track one or more post-processing methodologies for fusing, fixing or otherwise finishing the image marking material on the continuous feed or web material image receiving media, and/or other post-processing techniques that the continuous feed or web material image receiving media substrate, as marked, may undergo in the production of the output document. This information may aid in establishing conditions that may be determined by the processor 720 to make the formation of wrinkles more likely.

Processor(s) 720 may include at least one conventional processor or microprocessor that interprets and executes instructions to direct specific functioning of the exemplary control system 700 and an associated image forming system for processing and/or post-processing of the documents.

The exemplary control system 700 may include one or more data storage devices 730. Such data storage device(s) 730 may be used to store data or operating programs to be used by the exemplary control system 700, and specifically the processor(s) 720 in carrying into operation the disclosed functions. Data storage device(s) 730 may be used to store information regarding the above-listed examples of applicable image forming system characteristics. Stored schemes and operating parameters may be referenced to control aspects of the image forming functions as well as determining differential pressures to be applied to address certain wrinkle conditions in the continuous feed or web material image receiving media. Data storage device(s) 730 may, for example, store a database of updateable initial pressure settings for different widths and weights of the continuous feed or web material image receiving media to be referenced as initial pressure actuator settings to avoid wrinkle formation in the continuous feed or web material image receiving media.

The data storage device(s) 730 may include a random access memory (RAM) or another type of dynamic storage device that is capable of storing updatable database information, and for separately storing instructions for execution of system operations by, for example, processor(s) 720. Data storage device(s) 730 may also include a read-only memory (ROM), which may include a conventional ROM device or another type of static storage device that stores static information and instructions for processor(s) 720. Further, the data storage device(s) 730 may be integral to the exemplary control system 700, or may be provided external to, and in wired or wireless communication with, the exemplary control system 700.

The exemplary control system 700 may include at least one data output/display device 740, which may be configured as one or more conventional mechanisms that output information to a user, including, but not limited to, a display screen on a GUI of the image forming system with which the exemplary control system 700 may be associated. The data output/display device 740 may be used to indicate to a user feedback as to (1) detection of a wrinkle condition in the continuous feed or web material image receiving media, (2) status of automated adjustments made to address the wrinkle condition, including feedback controlled pressure reductions made once a wrinkle condition is mitigates, and/or (3) confirmation that the wrinkle condition has been mitigated and/or eliminated in the continuous feed or web material image receiving media.

Where appropriate, the exemplary control system 700 may include at least one external data communication interface 750 by which the exemplary control system 700 may communicate with the image forming system for effecting image forming operations and post-processing operations including passing pressure signals to the individual spanwise actuators when the exemplary control system 700 is mounted remotely from, and in wired or wireless communication with, the associated image forming system.

A web wrinkle sensor analyzing unit 760 may be provided as a standalone device or as a portion, and/or as a function, of the processor 720 in communication with the at least one data storage device 730. The web wrinkle sensor analyzing unit 760 may collect and process, at random intervals or continuously, information from one or more sensors positioned downstream of a fusing and drive nip that may be used for detecting a wrinkle condition in the continuous feed or web material image receiving media in the image forming system in the manner outlined above.

The web drive system control and tensioning unit 770 may generate signals to cause the feedback controlled automated pressure adjusting mechanism 650 described above with reference to FIG. 6, and particularly the independently controlled plurality of spanwise pressure actuators that comprise such a feedback controlled automated pressure adjusting mechanism, to independently adjust spanwise pressures in the fusing and drive nip formed by a high-load pressure roll and an opposing image side fusing roll. Signals generated by the web drive system control and tensioning unit 770 may be based on a detection and isolation of a wrinkle condition in the driven continuous feed or web material image receiving media as detected and analyzed by the web wrinkle sensor analyzing unit 760.

The web drive system control and tensioning unit 770 may in turn receive feedback signals from the actuators once the actuators have been set to pressures as directed by the control signals. At that point, and in cooperation with the web wrinkle sensor analyzing unit 760, a determination may be made, and separately reported to a user as to the correction of the wrinkle condition in the continuous feed or web material image receiving media. The web drive system control and tensioning unit 770 may continue to implement an iterative process of updating the generated signals to reduce system loading across the independently controlled plurality of spanwise pressure actuators to a minimal level at which the wrinkle condition remains addressed. In this manner, components of the exemplary control system 700 constantly seek to detect and address a wrinkle condition while incrementally adjusting pressures in the independently controlled plurality of spanwise pressure actuators to levels that are optimized to reduce component wear in the image forming system.

All of the various components of the exemplary control system 700, as depicted in FIG. 7, may be connected internally, and potentially to a processing or post-processing device in an image forming system, by one or more data/control busses 780. These data/control busses 780 may provide wired or wireless communication between the various components of the exemplary control system 700, whether all of those components are housed integrally in, or are otherwise external and connected to, other components of an image forming system with which the exemplary control system 700 may be associated.

It should be appreciated that, although depicted in FIG. 7 as an essentially integral unit, the various disclosed elements of the exemplary control system 700 may be arranged in any combination of sub-systems as individual components or combinations of components, integral to a single unit, or external to, and in wired or wireless communication with, the single unit of the exemplary control system 700. In other words, no specific configuration as an integral unit or as a support unit is to be implied by the depiction in FIG. 7. Further, although depicted as individual units for ease of understanding of the details provided in this disclosure regarding the exemplary control system 700, it should be understood that the described functions of any of the individually-depicted components may be undertaken, for example, by one or more processors 720 connected to, and in communication with, one or more data storage device(s) 730, all of which may support operations in the associated image forming system.

Figure 8A:
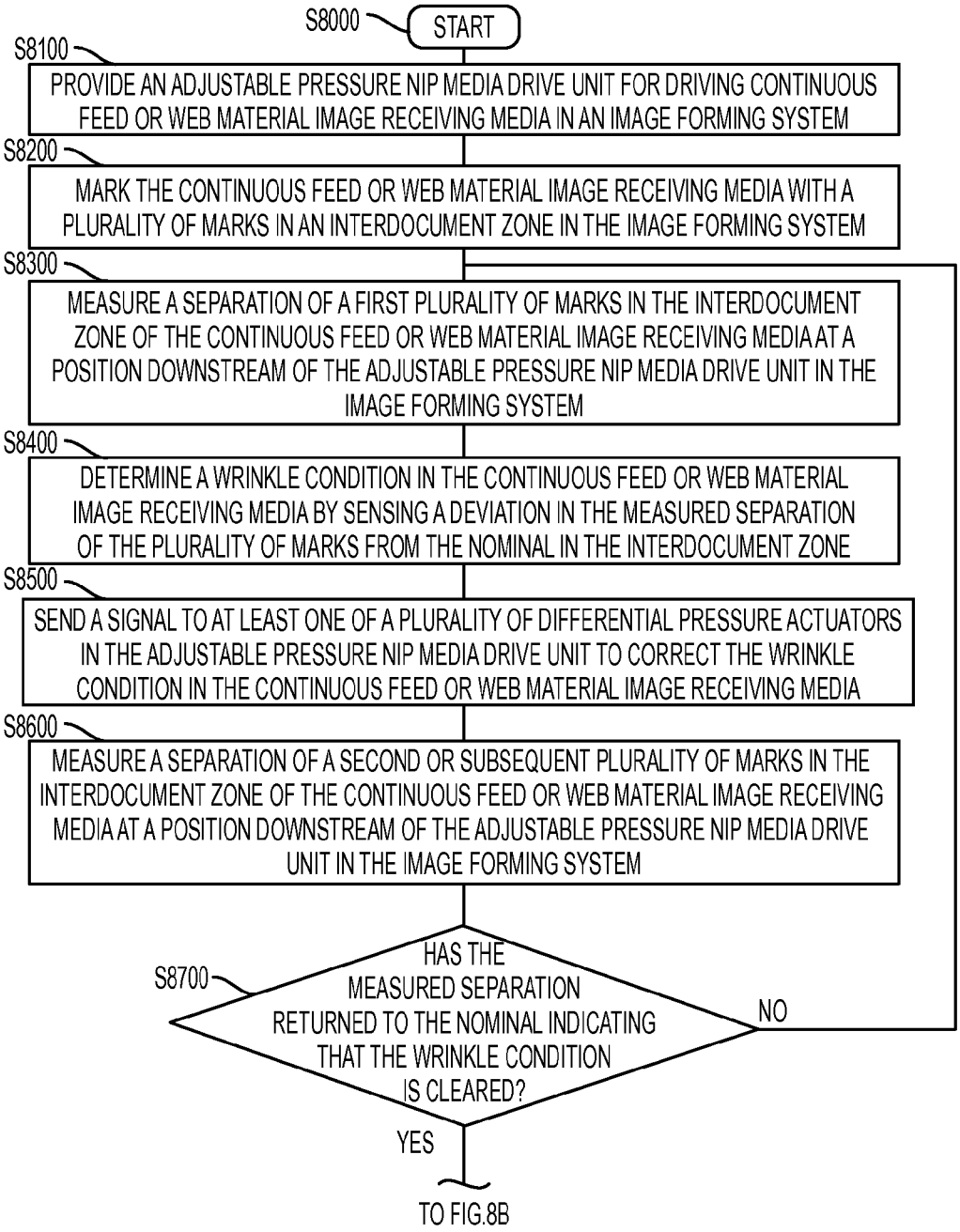
FIGS. 8A and 8B illustrate a flowchart of an exemplary method for implementing a closed-loop control scheme for controlling characteristics of an adjustable pressure system supporting automated wrinkle removal according to this disclosure.
Figure 8B:
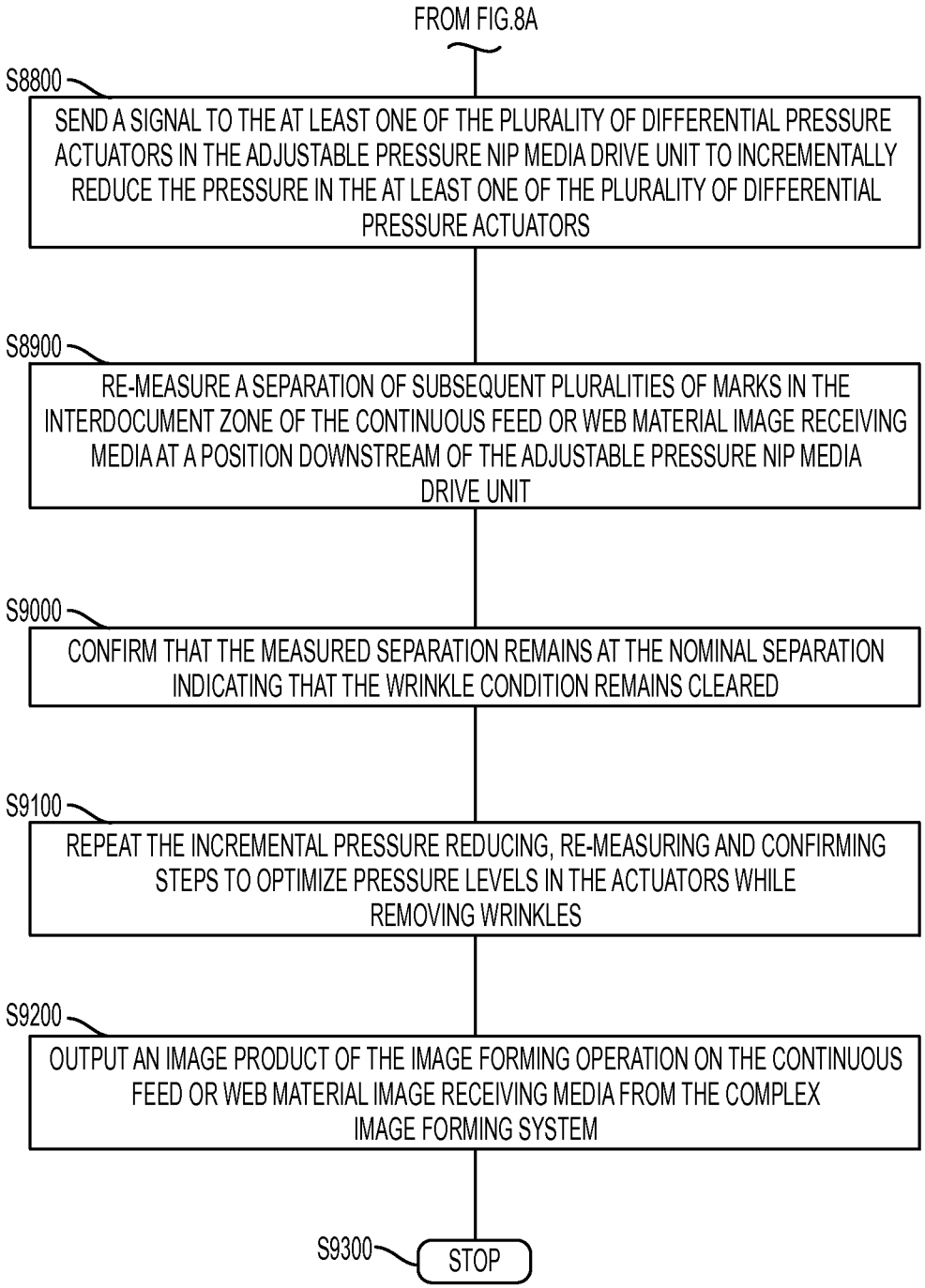

The disclosed embodiments may include an exemplary method for implementing a control scheme for controlling characteristics of an adjustable pressure system supporting automated wrinkle removal from web media in an image forming system. FIG. 8 illustrates a flowchart of such an exemplary method. As shown in FIG. 8, operation of the method commences at Step S8000 and proceeds to Step S8100.

In Step S8100, an adjustable pressure nip media drive unit for driving continuous feed or web material image receiving media in an image forming system may be provided. See, e.g. FIG. 2. Operation of the method proceeds to Step S8200.

In Step S8200, the continuous feed or web material image receiving media may be marked with a plurality of marks in at least one inter-document zone by the marking module of the image forming system. See, e.g., FIG. 3. Operation of the method proceeds to Step S8300.

In Step S8300, a separation of the first plurality of marks in the inter-document zone of the continuous feed or web material image receiving media may be measured at a position when the continuous feed or web material image receiving media has passed downstream of the adjustable pressure nip media drive unit in the image forming system. Operation of the method proceeds to Step S8400.

In Step S8400, the existence of a wrinkle condition in the continuous feed or web material image receiving media may be determined by sensing a deviation in the measured separation of the first plurality of marks and a nominal separation of the first plurality of marks in the inter-document zone. Operation of the method proceeds to Step S8500.

In Step S8500, a signal may be sent to at least one of a plurality of differential pressure actuators in the adjustable pressure nip media drive unit to correct the wrinkle condition in the continuous feed or web material image receiving media in the manner described above. Operation of the method proceeds to Step S8600.

In Step S8600, a separation of a second plurality of marks in the inter-document zone of the continuous feed or web material image receiving media may be measured at a position when the continuous feed or web material image receiving media has passed downstream of the adjustable pressure nip media drive unit in the image forming system. Operation of the method proceeds to Step S8700.

Step S8700 is a determination step. In Step S8700, a determination is made regarding whether, based on a measured separation of the second plurality of marks in the inter-document zone having returned to a nominal value, the wrinkle condition in the continuous feed or web material image receiving media has been eliminated.

If in Step S8700, it is determined that the wrinkle condition in the continuous feed or web material image receiving media has not been eliminated, operation of the method reverts to Step S8300.

If in Step S8700, it is determined that the wrinkle condition in the continuous feed or web material image receiving media has been eliminated, operation of the method proceeds to Step S8800.

In Step S8800, a signal may be sent to the at least one of a plurality of differential pressure actuators in the adjustable pressure nip media drive unit to incrementally reduce the pressure in the at least one of a plurality of differential pressure actuators. An objective of this step is to readjust the overall pressure between the opposing rolls while maintaining a delta pressure with lower overall force. Operation of the method proceeds to Step S8900.

In Step S8900, a separation of subsequent pluralities of marks in the inter-document zone of the continuous feed or web material image receiving media may be measured at a position when the continuous feed or web material image receiving media has passed downstream of the adjustable pressure nip media drive unit. Operation of the method proceeds to Step S9000.

In Step S9000, a determination may be made to confirm, based on a measured separation of the subsequent pluralities of marks in the inter-document zone having returned to a nominal value, that the wrinkle condition in the continuous feed or web material image receiving media remains eliminated. Operation of the method proceeds to Step S9100.

In Step S9100, the incremental pressure reducing, remeasuring and confirming steps may be repeated to optimize pressure levels in the actuators while removing wrinkles. Operation of the method proceeds to Step S9200.

In Step S9200, an image product of the image forming operation on the continuous feed or web material image receiving media may be output from the complex image forming system. Operation of the method proceeds to Step S9300, where operation of the method ceases.

The above-described exemplary systems and methods reference certain conventional components to provide a brief, general description of suitable document processing and post-processing means by which to carry out the disclosed wrinkle elimination techniques in support of image forming operations in the image forming system. Those skilled in the art will appreciate that other embodiments of the disclosed subject matter may be practiced with many types and configurations of individual devices and combinations of devices particularly common to image forming and post processing of image formed products in image forming devices of varying complexity. No limitation to the variety or configuration of individual component devices included in image forming systems of varying complexity is to be inferred from the above description.

The exemplary depicted sequence of executable instructions represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 8, and the accompanying description, except where a particular method step is a necessary precondition to execution of any other method step. Individual method steps may be carried out in sequence or in parallel in simultaneous or near simultaneous timing, as appropriate.

Although the above description may contain specific details, they should not be construed as limiting the claims in any way. Other configurations of the described embodiments of the disclosed systems and methods are part of the scope of this disclosure.

It will be appreciated that a variety of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A method for handling a continuous feed web material image receiving medium in an image forming system, comprising:

providing a continuous feed web material image receiving medium in an image forming system;

providing a nip-based media driving unit in which at least two opposing rollers are positioned to face each other to form a media driving nip;

providing an adjustable pressure device by which at least one of the two opposing rollers is controlled to adjust a pressure between the at least two opposing rollers at the media driving nip;

operating the nip-based driving unit to drive the continuous feed web material image receiving medium through at least a portion of the image forming system in a process direction;

measuring, with a sensor positioned downstream of the media driving nip, a separation between a first plurality of marks on a surface of the continuous feed web material image receiving medium, the first plurality of marks having a predetermined separation in a cross-process direction;

comparing, with a processor, the measured separation between the first plurality of marks with the predetermined separation between the first plurality of marks to detect a wrinkle condition in the continuous feed web material image receiving medium;

automatically generating, with the processor, at least one signal to adjust a pressure in the adjustable pressure device based on the comparing detecting a wrinkle condition in the continuous feed web material image receiving medium, the adjusted pressure reducing the detected wrinkle condition in the continuous feed web material image receiving medium, the first plurality of marks including at least a first mark in a vicinity of a first edge of the continuous feed web material image receiving medium in the cross-process direction, a second mark in a vicinity of a center of the continuous feed web material image receiving medium in the cross-process direction, and a third mark in a vicinity of a second edge of the continuous feed web material image receiving medium opposite the first edge in the cross-process direction, and the predetermined separation of the plurality of marks comprising a first predetermined separation between the first mark and the third mark, a second predetermined separation between the first mark and the second mark, and a third predetermined separation between the second mark and the third mark in a cross-process direction;

measuring, with the sensor positioned downstream of the media driving nip, at least two of (1) a separation between the first mark and the third mark, (2) a separation between the first mark in the second mark, and (3) a separation between the second mark in the third mark;

comparing, with the processor, the measured separation between the first mark and the third mark with the first predetermined separation, the measured separation between the first mark and the second mark with the second predetermined separation, and the measured separation between the second mark and the third mark with the third predetermined separation to isolate the wrinkle condition in the cross-process direction to a vicinity of one of the first edge or second edge of the continuous feed web material image receiving medium, the adjustable pressure device comprising a plurality of span-wise discrete individual pressure actuators that varyingly adjust the pressure in the adjustable pressure device differentially across a span-wise length of the media driving nip, each of the plurality of span-wise discrete individual pressure actuators receiving a different discrete signal from the processor to adjust the pressure in the each of the plurality of span-wise discrete individual pressure actuators, the processor automatically generating the different discrete signals to increase a differential pressure in the media driving nip toward the one of the first edge or second edge of the continuous feed web material image receiving medium to which the wrinkle condition is isolated;

measuring, with the sensor positioned downstream of the media driving nip, a separation between a second plurality of marks on a surface of the continuous feed web material image receiving medium, the second plurality of marks being presented on the surface of the continuous feed web material image receiving medium in the same manner as the first plurality of marks, and positioned upstream of the first plurality of marks on the continuous feed web material image receiving medium in a manner that causes the second plurality of marks to pass the sensor at an interval after the first plurality of marks passes the sensor, the interval being long enough for the differential pressure in the media driving nip to be effected; and determining, with the processor, that the differential pressure in the media driving nip substantially corrected the wrinkle condition in the continuous feed web material image receiving medium or that further modification of the differential pressure is warranted, the processor automatically generating the different discrete signals to incrementally reduce a pressure exerted by the each of the plurality of span-wise discrete individual pressure actuators resulting in an overall incremental decrease in the spanwise nip pressure while maintaining the differential pressure in the media driving nip.

2. The method of claim 1, the first plurality of marks being pre-printed on the surface of the continuous feed web material image receiving medium.

3. The method of claim 1, further comprising marking, with a marking engine in the image forming system, the first plurality of marks on the surface of the continuous feed web material image receiving medium.

4. The method of claim 1, with each incremental pressure reduction, measuring, with the sensor positioned downstream of the media driving nip, a separation between subsequent pluralities of marks on the surface of the continuous feed web material image receiving medium, the subsequent pluralities of marks being presented on the surface of the continuous feed web material image receiving medium in the same manner as the first and second pluralities of marks, and positioned upstream of the first and second pluralities of marks on the continuous feed web material image receiving medium in a manner that causes the subsequent pluralities of marks to pass the sensor at an interval after the first and second pluralities of marks pass the sensor, the interval being long enough for each incremental pressure reduction to be effected;

determining, with the processor, that the wrinkle condition is reintroduced in the continuous feed web material image receiving medium based on the measuring; and ceasing the incremental pressure reduction, the processor automatically generating the different discrete signals to increase the pressure exerted by the each of the plurality of span-wise discrete individual pressure actuators to return the spanwise nip pressure to a pressure level before the last incremental pressure reduction.

5. The method of claim 1, further comprising providing feedback to a user regarding at least a result of the determining that the wrinkle condition in the continuous feed web material image receiving medium is substantially corrected.

6. The method of claim 1, the plurality of span-wise discrete individual pressure actuators comprising at least one of a piston device, a lever device, an other mechanical actuator, an air inflatable device and an air bag.

7. The method of claim 1, the processor referencing stored values to set initial pressures for the plurality of span-wise discrete individual pressure actuators based on at least one of a width of the continuous feed web material image receiving medium, a weight of the continuous feed web material image receiving medium, an environmental temperature and an environmental relative humidity.

8. A device for handling a continuous feed web material image receiving medium in an image forming system, comprising:

a nip-based media driving unit in which at least two opposing rollers are positioned to face each other to form a media driving nip;

an adjustable pressure device by which at least one of the two opposing rollers is controlled to adjust a pressure between the at least two opposing rollers at the media driving nip;

a sensor positioned downstream of the media driving nip in a process direction to measure a separation between a first plurality of marks on a surface of the continuous feed web material image receiving medium, the first plurality of marks having a predetermined separation in a cross-process direction; and a processor that is programmed to:

compare the measured separation between the first plurality of marks with the predetermined separation between the first plurality of marks to detect a wrinkle condition in the continuous feed web material image receiving medium, and automatically generate at least one signal to adjust a pressure in the adjustable pressure device based on the comparing detecting a wrinkle condition in the continuous feed web material image receiving medium, the adjusted pressure reducing the detected wrinkle condition in the continuous feed web material image receiving medium, the first plurality of marks comprising at least a first mark in a vicinity of a first edge of the continuous feed web material image receiving medium in the cross-process direction, a second mark in a vicinity of a center of the continuous feed web material image receiving medium in the cross-process direction, and a third mark in a vicinity of a second edge of the continuous feed web material image receiving medium opposite the first edge in the cross-process direction, and the predetermined separation of the plurality of marks comprising a first predetermined separation between the first mark and the third mark, a second predetermined separation between the first mark and the second mark, and a third predetermined separation between the second mark and the third mark in a cross-process direction, the sensor being configured to measure at least two of (1) a separation between the first mark and the third mark, (2) a separation between the first mark in the second mark, and (3) a separation between the second mark in the third mark, and the processor being further programmed to compare the measured separation between the first mark and the third mark with the first predetermined separation, the measured separation between the first mark and the second mark with the second predetermined separation, and the measured separation between the second mark and the third mark with the third predetermined separation to isolate the wrinkle condition in the cross-process direction to a vicinity of one of the first edge or second edge of the continuous feed web material image receiving medium, the adjustable pressure device comprising a plurality of span-wise discrete individual pressure actuators that varyingly adjust the pressure in the adjustable pressure device differentially across a span-wise length of the media driving nip, each of the plurality of span-wise discrete individual pressure actuators receiving a different discrete signal from the processor to adjust the pressure in the each of the plurality of span-wise discrete individual pressure actuators, the processor being further programmed to automatically generate the different discrete signals to increase a differential pressure in the media driving nip toward the one of the first edge or second edge of the continuous feed web material image receiving medium to which the wrinkle condition is isolated, the sensor measuring a separation between a second plurality of marks on a surface of the continuous feed web material image receiving medium, the second plurality of marks being presented on the surface of the continuous feed web material image receiving medium in the same manner as the first plurality of marks, and positioned upstream of the first plurality of marks on the continuous feed web material image receiving medium in a manner that causes the second plurality of marks to pass the sensor at an interval after the first plurality of marks passes the sensor, the interval being long enough for the differential pressure in the media driving nip to be effected, and the processor being further programmed to determine that (1) the differential pressure in the media driving nip substantially corrected the wrinkle condition in the continuous feed web material image receiving medium, or (2) further modification of the differential pressure in the media driving nip is warranted, and the processor being further programmed to automatically generate the different discrete signals to incrementally reduce a pressure exerted by the each of the plurality of span-wise discrete individual pressure actuators resulting in an overall incremental decrease in the spanwise nip pressure while maintaining the differential pressure in the media driving nip.

9. The device of claim 8, the first plurality of marks being pre-printed on the surface of the continuous feed web material image receiving medium.

10. The device of claim 8, further comprising a marking engine that forms the first plurality of marks on the surface of the continuous feed web material image receiving medium.

11. The device of claim 8, with each incremental pressure reduction, the sensor measuring a separation between subsequent pluralities of marks on the surface of the continuous feed web material image receiving medium, the subsequent pluralities of marks being presented on the surface of the continuous feed web material image receiving medium in the same manner as the first and second pluralities of marks, and positioned upstream of the first and second pluralities of marks on the continuous feed web material image receiving medium in a manner that causes the subsequent pluralities of marks to pass the sensor at an interval after the first and second pluralities of marks pass the sensor, the interval being long enough for each incremental pressure reduction to be effected, the processor being further programmed to:

determine the wrinkle condition is reintroduced in the continuous feed web material image receiving medium based on the measuring;

cease the incremental pressure reduction; and automatically generate the different discrete signals to increase the pressure exerted by the each of the plurality of span-wise discrete individual pressure actuators to return the spanwise nip pressure to a pressure level before the last incremental pressure reduction.

12. The device of claim 11, further comprising a display unit to which the processor sends information regarding at least a result of the determining to be displayed as information to a user.

13. The device of claim 8, the plurality of span-wise discrete individual pressure actuators comprising at least one of a piston device, a lever device, an other mechanical actuator, an air inflatable device and an air bag.

14. The device of claim 8, further comprising a data storage device storing initial pressure values for the plurality of span-wise discrete individual pressure actuators based on at least one of a width of the continuous feed web material image receiving medium, a weight of the continuous feed web material image receiving medium, an environmental temperature and an environmental relative humidity, the processor referencing the stored initial pressure values to set initial pressures for the plurality of span-wise discrete individual pressure actuators.

15. A non-transitory computer readable medium on which is stored a set of instructions that, when executed by a processor, cause the processor to execute the steps of a method for handling a continuous feed web material image receiving medium in an image forming system, the method comprising:

operating a nip based driving unit to drive a continuous feed web material image receiving medium through at least a portion of the image forming system in a process direction, the nip based driving unit comprising:

at least two opposing rollers that are positioned in a first position to face each other in a manner that forms a media driving nip, and an adjustable pressure device to which at least one of the two opposing rollers is mounted that adjusts a pressure at the media driving nip;

measuring, with a sensor positioned downstream of the media driving nip, a separation between a first plurality of marks on a surface of the continuous feed web material image receiving medium, the plurality of marks having a predetermined separation in a cross-process direction;

comparing the measured separation of the first plurality of marks with the predetermined separation of the first plurality of marks to detect a wrinkle condition in the continuous feed web material image receiving medium;

automatically generating a signal to adjust a pressure in the adjustable pressure device based on the comparing detecting a wrinkle condition in the continuous feed web material image receiving medium to reduce the detected wrinkle condition in the continuous feed web material image receiving medium;

measuring, with the sensor, a separation between a second plurality of marks on a surface of the continuous feed web material image receiving medium, the second plurality of marks being presented on the surface of the continuous feed web material image receiving medium in the same manner as the first plurality of marks, and positioned upstream of the first plurality of marks on the continuous feed web material image receiving medium in a manner that causes the second plurality of marks to pass the sensor at an interval after the first plurality of marks passes the sensor, the interval being long enough for the differential pressure in the media driving nip to be effected;

determining that the differential pressure in the media driving nip substantially corrected the wrinkle condition in the continuous feed web material image receiving medium or that further modification of the differential pressure is warranted;

providing feedback to a user regarding at least a result of the determining that the wrinkle condition in the continuous feed web material image receiving medium is substantially corrected or that further modification of the differential pressure is warranted; the adjustable pressure device comprising a plurality of span-wise discrete individual pressure actuators that varyingly adjust the pressure in the adjustable pressure device differentially across a span-wise length of the media driving nip, each of the plurality of span-wise discrete individual pressure actuators receiving a different discrete signal from the processor to adjust the pressure in the each of the plurality of span-wise discrete individual pressure actuators; and the processor automatically generating the different discrete signals to incrementally reduce a pressure exerted by the each of the plurality of span-wise discrete individual pressure actuators resulting in an overall incremental decrease in the spanwise nip pressure while maintaining the differential pressure in the media driving nip.

16. The non-transitory computer readable medium of claim 15, the first plurality of marks being pre-printed on the surface of the continuous feed web material image receiving medium.

17. The non-transitory computer readable medium of claim 15, the method further comprising marking, with a marking engine in the image forming system, the first plurality of marks on the surface of the continuous feed web material image receiving medium.

18. The non-transitory computer readable medium of claim 15, the first plurality of marks comprising at least a first mark in a vicinity of a first edge of the continuous feed web material image receiving medium in the cross-process direction, a second mark in a vicinity of a center of the continuous feed web material image receiving medium in the cross-process direction, and a third mark in a vicinity of a second edge of the continuous feed web material image receiving medium opposite the first edge in the cross-process direction, and the predetermined separation of the plurality of marks comprising a first predetermined separation between the first mark and the third mark, a second predetermined separation between the first mark and the second mark, and a third predetermined separation between the second mark and the third mark in a cross-process direction.

19. The non-transitory computer readable medium of claim 18, the method further comprising:

measuring, with the sensor positioned downstream of the media driving nip, at least two of (1) a separation between the first mark and the third mark, (2) a separation between the first mark in the second mark, and (3) a separation between the second mark in the third mark; and comparing, with the processor, the measured separation between the first mark and the third mark with the first predetermined separation, the measured separation between the first mark and the second mark with the second predetermined separation, and the measured separation between the second mark and the third mark with the third predetermined separation to isolate the wrinkle condition in the cross-process direction to a vicinity of one of the first edge or second edge of the continuous feed web material image receiving medium.

20. The non-transitory computer readable medium of claim 15, the processor automatically generating the different discrete signals to increase a differential pressure in the media driving nip toward the one of the first edge or second edge of the continuous feed web material image receiving medium to which the wrinkle condition is isolated.

21. The non-transitory computer readable medium of claim 15, the plurality of span-wise discrete individual pressure actuators comprising at least one of a piston device, a lever device, an other mechanical actuator, an air inflatable device and an air bag.

22. The non-transitory computer readable medium of claim 15, the processor referencing stored values to set initial pressures for the plurality of span-wise discrete individual pressure actuators based on at least one of a width of the continuous feed web material image receiving medium, a weight of the continuous feed web material image receiving medium, an environmental temperature and an environmental relative humidity.

23. The non-transitory computer readable medium of claim 15, the method further comprising:

with each incremental pressure reduction, measuring, with the sensor positioned downstream of the media driving nip, a separation between subsequent pluralities of marks on the surface of the continuous feed web material image receiving medium, the subsequent pluralities of marks being presented on the surface of the continuous feed web material image receiving medium in the same manner as the first and second pluralities of marks, and positioned upstream of the first and second pluralities of marks on the continuous feed web material image receiving medium in a manner that causes the subsequent pluralities of marks to pass the sensor at an interval after the first and second pluralities of marks pass the sensor, the interval being long enough for each incremental pressure reduction to be effected;

determining, with the processor, that the wrinkle condition is reintroduced in the continuous feed web material image receiving medium based on the measuring; and ceasing the incremental pressure reduction, the processor automatically generating the different discrete signals to increase the pressure exerted by the each of the plurality of span-wise discrete individual pressure actuators to return the spanwise nip pressure to a pressure level before the last incremental pressure reduction.

* * * * *